US006013425A

United States Patent [19]

Craver et al.

[11] Patent Number: 6,013,425

[45] Date of Patent: Jan. 11, 2000

[54] CONCENTRATED PHOTOGRAPHIC FIXER ADDITIVE AND FIXING COMPOSITIONS CONTAINING TRIAZINYLSTILBENE AND METHOD OF PHOTOGRAPHIC PROCESSING

[75] Inventors: Mary E. Craver, Rochester; Jean M. Buongiorne, Brockport, both of N.Y.

[73] Assignee: Eastman Kodak Company, Rochester, N.Y.

[21] Appl. No.: 09/282,994

[22] Filed: Mar. 31, 1999

Related U.S. Application Data

[62] Division of application No. 09/109,466, Jul. 6, 1998, Pat. No. 5,955,248.

[51] Int. Cl.[7] ..... G03C 7/42

[52] U.S. Cl. ..... 430/455; 430/933

[58] Field of Search ..... 430/455, 933

[56] References Cited

U.S. PATENT DOCUMENTS

| | | | |
|---|---|---|---|
| 4,232,112 | 11/1980 | Kuse | 430/393 |
| 4,587,195 | 5/1986 | Ishikawa et al. | 430/139 |
| 4,895,786 | 1/1990 | Kurematsu et al. | 430/139 |
| 5,043,253 | 8/1991 | Ishikawa | 430/393 |
| 5,147,765 | 9/1992 | Goto et al. | 430/376 |
| 5,221,597 | 6/1993 | Fujita et al. | 430/393 |
| 5,395,742 | 3/1995 | Deguchi et al. | 430/933 |

FOREIGN PATENT DOCUMENTS

| | | |
|---|---|---|
| 2203302 | 6/1973 | Germany . |
| 58-222156 | 12/1983 | Japan . |
| 1158443 | 3/1989 | Japan . |
| 1062642 | 11/1989 | Japan . |
| 10104809 | 4/1998 | Japan . |

*Primary Examiner*—Hoa Van Le
*Attorney, Agent, or Firm*—J. Lanny Tucker

[57] ABSTRACT

Concentrated and working strength photographic fixing compositions include a photographic fixing agent, a triazinylstilbene compound, and a water-soluble stabilizing compound that has a molecular weight of less than 200, from 2 to 10 carbon atoms, and at least two amino or hydroxy functional groups. The triazinylstilbene is provided in a concentrated fixer additive composition in a mixture with the stabilizing compound. The fixing compositions also include predominantly ammonium ions, and can be used to provide images in color photographic materials, and particularly in color reversal films, with reduced residual sensitizing dye stain.

13 Claims, No Drawings

CONCENTRATED PHOTOGRAPHIC FIXER ADDITIVE AND FIXING COMPOSITIONS CONTAINING TRIAZINYLSTILBENE AND METHOD OF PHOTOGRAPHIC PROCESSING

RELATED APPLICATION

This application is a Divisional of U.S. Ser. No. 09/109,466 filed Jul. 6, 1998, U.S. Pat. No. 5,955,248.

FIELD OF THE INVENTION

This invention relates to novel concentrated photographic fixer additive and photographic fixing compositions. It also relates to working strength photographic fixing compositions prepared using the noted concentrates, and to a method of providing a photographic image using the compositions in photoprocessing. Thus, this invention relates to the photographic industry, and to photochemical processing in particular.

BACKGROUND OF THE INVENTION

The conventional image-forming process of silver halide photography includes imagewise exposure of a photographic silver halide recording material to actinic radiation (such as actinic light), and the eventual manifestation of a useable image by wet photochemical processing of that exposed material. A fundamental step of photochemical processing is the treatment of the material with one or more developing agents to reduce silver halide to silver metal. With black-and-white photographic materials, the metallic silver usually comprises the image. With color photographic materials, the useful image consists of one or more images in organic dyes produced from an oxidized developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved with an oxidizing agent, commonly known as a bleaching agent.

Fixing is typically carried out using a fixing composition that includes one or more fixing agents such as thiosulfate salts. Both ammonium and sodium thiosulfate salts are known. Fixing solutions containing ammonium ions are preferred for providing more rapid fixing, but they present environmental concerns. Thus, fixing solutions containing sodium ions, while slower, are also advantageous.

Color photographic silver halide materials often contain various sensitizing dyes that extend the inherent photosensitivity of the photosensitive silver halide emulsions to electromagnetic radiation. One important class of such sensitizing dyes are carbocyanine sensitizing dyes that are commonly included in silver halide emulsion layers in photographic silver halide films, for example in color reversal photographic silver halide films (films normally used to provide positive color images).

Many photographic silver halide elements contain residual sensitizing dyes after photoprocessing. In some cases, the level of retained sensitizing dyes is inconsequential and thus, unobservable. In other instances, however, the high level of retained sensitizing dye results in undesirably high dye stain (or unwanted color) in the elements.

A number of solutions have been proposed for this problem, including the inclusion of water-soluble stilbene optical brighteners in the color developer solution [as described for example, in *Research Disclosure,* 20733, page 268, July, 1981 and U.S. Pat. No. 4,587,195 (Ishikawa et al)], the bleach-fixing solution [as described for example, in JP 1-062642 (published Mar. 9, 1989), JP 1-158443 (published Jun. 21, 1989), and U.S. Pat. No. 5,043,253 (Ishikawa)], or the stabilizing solution used at the end of the photoprocessing [as described for example in U.S. Pat. No. 4,895,786 (Kurematsu et al)].

In addition, it has been proposed to include stilbenes in sodium ion containing fixing solutions to solve the problem with retained sensitizing dye, as described in *Research Disclosure* 37336, page 340, May 1995. Such fixing solutions have sodium ions as the predominant cation because of the environmental concerns with the presence of ammonium ions. However, the presence of sodium ions slows down the fixing process, and this reduction in photoprocessing speed may be unacceptable in some instances. A reduction or elimination of the sodium ions for that reason may be required when certain films (such as color reversal films) are being processed.

We observed, however, that when the noted stilbene compounds were added to conventional ammonium ion containing fixing solutions at appropriate concentrations needed to reduce dye stain, the stilbene compounds were not stable over a desired shelf life. The stilbene compounds stayed in solution for a brief time after mixing, but upon storage for only a few hours, the solutions exhibited considerable precipitation. In fact, the *Research Disclosure* publication 37336 (noted above) also suggests that stilbene compounds are incompatible in fixing solutions containing high ammonium ion concentration. Thus, it would appear that there is no incentive for a skilled worker in the photographic industry to use stilbenes in fixing solutions containing high ammonium ion content.

There remains a need in the photographic industry for a way to decrease the dye stains resulting from retained sensitizing dye during photoprocessing carried out using high ammonium ion fixing compositions. Such fixing solutions are more desirable for faster photoprocessing of color reversal films. Moreover, while the prior art would suggest that certain stilbene compounds may be useful for reducing the effects of retained sensitizing dye, there is a need in the industry for a means to use them without the instability observed in high ammonium ion fixing compositions.

SUMMARY OF THE INVENTION

The problems with known photographic fixing compositions and photoprocessing methods are overcome with the use several embodiments of the present invention.

In one embodiment, the present invention provides a concentrated fixer additive composition comprising:

a) at least 0.025 mol/l of a triazinylstilbene, and b) a water-soluble aliphatic compound for stabilizing the triazinylstilbene, the stabilizing compound having a molecular weight of less than 200, from 2 to 10 carbon atoms, and at least two amino or hydroxy functional groups, and being present in the composition at a molar ratio to the triazinylstilbene of at least 2:1.

This concentrated fixer additive composition can be used to advantage to prepare the concentrated aqueous fixing composition of this invention, which composition has a pH of 8 or less and consists essentially of:

a) at least 2 mol/l of a photographic fixing agent, b) at least 5 mol/l of ammonium ions, with the concentration of ammonium ions being at least 60 mol % of the total cations in the composition, c) at least 0.001 mol/l of a triazinylstilbene, and d) a water-soluble aliphatic compound for stabilizing the triazinylstilbene, the stabilizing compound having a molecular weight of less than 200, from 2 to 10 carbon atoms, and at least two amino or hydroxy functional groups, and being present in the composition at a molar ratio to the triazinylstilbene of at least 2:1.

Once the concentrated aqueous fixing composition is prepared, it can be used to prepare the aqueous working strength fixing composition of this invention. This composition has a pH of 8 or less, and consists essentially of:

a) at least 0.1 mol/l of a photographic fixing agent, b) at least 0.25 mol/l of ammonium ions, with the concentration of ammonium ions being at least 60 mol % of the total cations in the composition, c) at least 0.0001 mol/l of a triazinylstilbene, and d) a water-soluble aliphatic compound for stabilizing the triazinylstilbene, the stabilizing compound having a molecular weight of less than 200, from 2 to 10 carbon atoms, and at least two amino or hydroxy functional groups, and being present in the composition at a molar ratio to the triazinylstilbene of at least 2:1.

This invention further provides a method of making an aqueous working strength fixing composition comprising the steps of:

A) preparing the concentrated aqueous photographic fixing composition noted above by mixing the concentrated fixer additive composition described above with the photographic fixing agent and ammonium ions, and B) diluting the resulting concentrated aqueous photographic fixing composition from about 3 to about 15 times.

This invention further provides a method for providing a color image comprising the steps of:

A) bleaching an imagewise exposed and color developed color photographic silver halide element, and B) prior to or after step A, fixing the photographic element with the aqueous working strength photographic fixing composition described above.

Step B of this method can also be carried out by diluting, at least 3 times, the concentrated aqueous photographic fixing composition described above.

The advantages of this invention are several. The concentrated fixer additive composition and high ammonium ion fixing composition can be manufactured, provided and stored for considerable time without precipitation of the triazinylstilbene, thereby reducing the costs associated with volume and storage. The resulting working strength fixing composition is also highly stable, and can be used to advantage to reduce stain from retained sensitizing dyes in processing photographic silver halide elements. The desired stability of the triazinylstilbene is achieved by including in the concentrated photographic fixing composition, a water-soluble aliphatic compound as a stabilizer. This compound generally has a molecular weight of less than 200, from 2 to 10 carbon atoms and at least two amino or hydroxy functional groups. The molar ratio of the aliphatic compound to the triazinylstilbene in the concentrated compositions is also critical, being at least 2:1. Fixing is achieved as rapidly as possible because ammonium ions represent the preponderance (at least 60 mol %) of cations in the fixing composition. Yet, the ammonium ions do not adversely affect the stability of the triazinylstilbene in the concentrated compositions.

The working strength fixing compositions can be prepared in several ways. The concentrated fixer additive composition can be added directly to a working strength composition containing a suitable fixing agent, or mixed with the appropriate fixing agents (using as ammonium ion salt) in appropriate amounts to form the concentrated aqueous fixing composition. This composition can then be diluted in an appropriate manner and used for photoprocessing.

DETAILED DESCRIPTION OF THE INVENTION

The concentrated and working strength photographic fixing compositions of the present invention perform only one photoprocessing function, fixing. They do not perform a bleaching function, so the compositions are not bleach-fixing compositions. The language "consisting essentially of" is intended to indicate that no photographic bleaching agents (such as iron chelates, peroxides or persulfates) are intentionally added to the fixing composition. Any small amounts of bleaching agents may be present merely because of carryover from previous photoprocessing baths.

As used herein unless otherwise indicated, the term "fixing compositions" refers to both the concentrated and working strength fixing compositions of this invention.

Useful fixing agents for photographic fixing compositions are well known. Examples of photographic fixing agents include, but not limited to, thiosulfates (for example sodium thiosulfate, potassium thiosulfate and ammonium thiosulfate), thiocyanates (for example sodium thiocyanate, potassium thiocyanate and ammonium thiocyanate), thioethers (such as ethylenebisthioglycolic acid and 3,6-dithia-1,8-octanediol), imides and thiourea. Thiosulfates and thiocyanates are preferred, and thiosulfates are more preferred. Ammonium thiosulfate is most preferred.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al).

A critical component of the concentrated fixer additive and fixing compositions of this invention is a water-soluble aliphatic compound that stabilizes the triazinylstilbenes (described below). These stabilizing aliphatic compounds can be used singly or in combination, and each has a molecular weight less than 200 (preferably less than 150). Each compound generally has from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The aliphatic compounds must also include at least two amino or hydroxy functional groups, or a combination of at least two of such groups.

Useful stabilizing compounds include, but are not limited to, polyols include glycols (such as ethylene glycol, diethylene glycol and triethylene glycol), polyhydroxyamines, including polyalcoholamines [such as diethanolamine, triethanolamine, diisopropanolamine, N,N-bis(hydroxyethyl)amine, or 1,4-dihydroxypyridine]. The term "polyhydroxyamines" include cyclic amines that have at least two hydroxy moieties attached to the ring. Glycols are preferred with diethylene glycol being most preferred. Of the dialcoholamines, triethanolamine is most preferred.

Another critical component of the concentrated fixer additive and photographic fixing compositions of this invention is a triazinylstilbene (or mixture thereof). In some publications, triazinylstilbenes are identified as "triazylstilbenes". Preferably, the useful triazinylstilbenes are water-soluble or water-dispersible.

While not intending to be limiting in the definition of triazinylstilbenes useful in the practice of this invention, generally they can be represented by structure I:

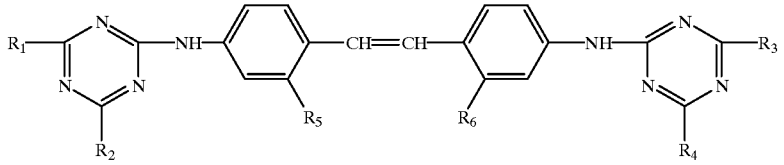

wherein $R_1$, $R_2$, $R_3$ and $R_4$ are independently hydroxy, halo (such as fluoro, chloro, bromo or iodo), a substituted or unsubstituted morpholino group, a substituted or unsubstituted aryl group generally having 6 to 10 carbon atoms in the carbocyclic ring (such as phenyl, a methoxyphenyl or a halophenyl), substituted or unsubstituted alkoxy group generally having a chain of from 1 to 10 carbon atoms that can be interrupted with one or more oxy, amino or carbonyl groups (such as methoxy, ethoxy, isopropoxy and t-butoxy), substituted or unsubstituted aryloxy group generally having from 6 to 10 carbon atoms in the carbocyclic ring (such as phenoxy or a chlorophenoxy), a substituted or unsubstituted alkyl group generally having from 1 to 10 carbon atoms (such as methyl, ethyl, isopropyl, t-butyl, n-hexyl, methoxymethyl, 2-chloroethyl and benzyl), an amino group (both cyclic and acyclic), an alkylamino group (both secondary and tertiary amines, each alkyl group as defined above) or an arylamino group (both secondary and tertiary, each aryl group as defined above. Preferably, $R_1$, $R_2$, $R_3$ and $R_4$ are independently an alkoxy group, an alkylamino group or an arylamino group, as defined above.

$R_5$ and $R_6$ are independently hydrogen or sulfo, provided at least one of $R_5$ and $R_6$ is sulfo. In preferred embodiments, each of these radicals is sulfo. The sulfo can be in free acid or salt form (sodium, potassium or ammonium salts).

Representative compounds within structure I are shown in U.S. Pat. No. 4,232,112 (Kuse), U.S. Pat. No. 4,587,195 (Ishikawa et al) and U.S. Pat. No. 5,043,253 (Ishakawa), all incorporated herein by reference with respect to such compounds. It is to be understood that at least some of these compounds can exist in various isomeric forms. Single isomers or mixtures thereof can also been used in the practice of this invention. The most preferred triazinylstilbene compounds (and isomers thereof) include compounds II and III, respectively, as follows:

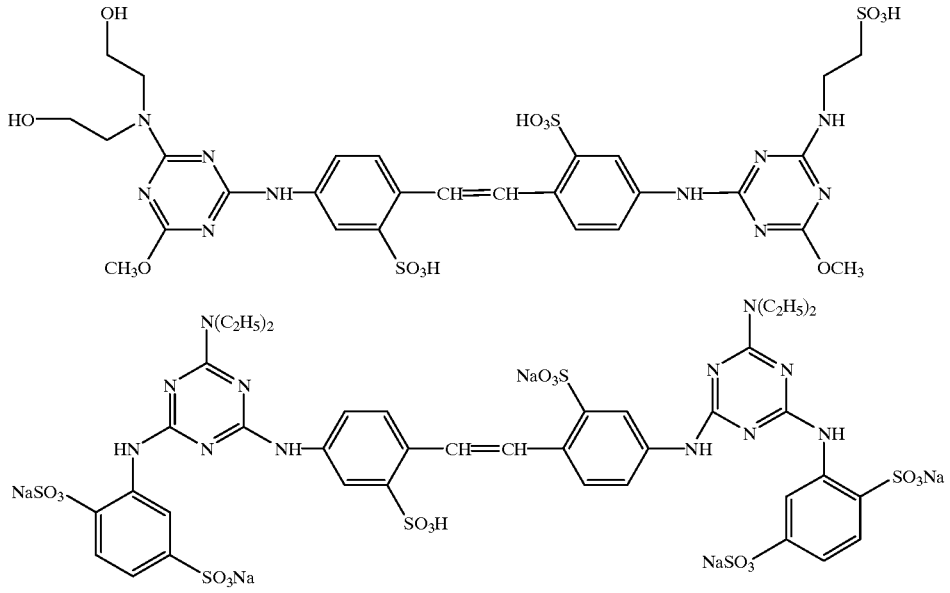

Compound II is most preferred, and is commercially available as BLANKOPHOR REU from Bayer. Compound III is commercially available as TINOPAL SFP from Ciba.

The fixing compositions of this invention generally contain one or more monovalent or divalent cations supplied by various salts used for various purposes (for example, salts of fixing agents and triazinylstilbenes). It is critical that ammonium ions comprise at least 60 mol %, preferably from about 70 to 100, and more preferably, from about 70 to about 80, mol % of the total monovalent and divalent cations in the composition. The remainder of the cations can be lithium, sodium, potassium, calcium or magnesium ions.

The fixing compositions of this invention can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art. The amounts useful in the concentrate compositions would be readily apparent from the teaching included herein.

The desired pH of both the fixing compositions of this invention is 8 or less, and can be achieved and maintained using any useful combination of acids and bases, as well as various buffers. The pH of the concentrated fixing composition can vary from that of the working strength fixing composition.

Other details of fixing compositions not explicitly described herein are considered well known in the art, and are described for example, in *Research Disclosure* publication 38957 (noted below), and publications noted therein in paragraph XX(B), incorporated herein by reference.

The following TABLE I shows the general and preferred pH and amounts of essential components of the concentrated fixer additive composition and the fixing compositions of this invention. The preferred ranges are listed in parentheses (), and all of the ranges are considered to be approximate or "about" in the upper and lower end points. During fixing, the actual concentrations can vary depending upon extracted chemicals in the composition, fixer replenishment rates, water losses due to evaporation and carryover from the preceding processing bath and carryover to the next processing bath. The working strength fixing composition concentrations are based on an about 3 to about 15 dilution rate of the concentrated fixing composition. The amount of stabilizing compound is a molar ratio in reference to the amount of triazinylstilbene.

| COMPONENT | CONCENTRATED FIXER ADDITIVE COMPOSITION | CONCENTRATED FIXING COMPOSITION | WORKING STRENGTH FIXING COMPOSITION |
|---|---|---|---|
| Fixing agent | None | 2–6 mol/l (3–5 mol/l) | 0.1–2 mol/l (0.2–1 mol/l) |
| Triazinylstilbene | 0.025–0.15 mol/l (0.05–0.1 mol/l) | 0.001–0.01 mol/l (0.002–0.006 mol/l) | 0.0001–0.0035 mol/l (0.00015–0.002 mol/l) |
| Aliphatic stabilizing compound | 2:1–150:1 (50:1–80:1) | 2:1–150:1 (50:1–80:1) | 2:1–150:1 (50:1–80:1) |
| Ammonium ions (% of cations) | Not applicable | 60–100 mol % (70–100 mol %) | 60–100 mol % (70–100 mol %) |
| Ammonium ions (conc.) | Not applicable | 5–12 mol/l (6–10 mol/l) | 0.25–4 mol/l (0.4–2 mol/l) |
| pH | Not applicable | 4.5–8 (5.5–7.5) | 4.5–8 (5.5–7.5) |

During fixing, the fixing composition in the processor may accumulate dissolved silver halide, and other substances that are extracted from the processed photographic element. Such materials, and particularly silver halide, can be removed using known means, such as ion exchange, electroysis, electrodialysis and precipitation.

Fixing can be carried out using a single working strength fixing composition bath (single stage), or multistage methods. Agitation or recirculation can also be used if desired. Fixing can also be carried out using any known method for contacting a fixing composition and the photographic element. Such methods include, but not limited to, immersing the photographic element in the working strength fixing composition, laminating a cover sheet containing the fixing composition to the photographic element, and applying the fixing composition by high velocity jet or spraying.

Since the fixing step is a separate step in an overall image-forming method, any processing sequence can be used for processing either black-and-white or color photographic elements. Representative processing sequences are described for example in *Research Disclosure* publication 308119, December 1989, publication 17643, December 1978, and publication 38957, September, 1996. *Research Disclosure* is a publication of Kenneth Mason Publications Ltd., Dudley House, 12 North Street, Emsworth, Hampshire PO10 7DQ England (or Emsworth Design Inc., 121 West 19th Street, New York, N.Y. 10011). For example, in processing black-and-white photographic elements, fixing is usually preceded by a developing step, and may be followed with one or more washing or stabilizing steps.

Preferably, the present invention is used to process color photographic elements, including but not limited to, color negative photographic films, color reversal photographic films, and color photographic papers. The general sequence of steps and conditions (times and temperatures) for processing are well known as Process C-41 and Process ECN-2 for color negative films, Process E-6 and Process K-14 for color reversal films, and Process RA-4 for color papers. The processing solutions used for the various processing steps in such processing sequences are also well known (except for the fixing steps carried out in this invention).

More preferably, the present invention is used to provide positive color images in color reversal photographic films. The typical sequence of steps includes first development (black-and-white development), reversal processing step, color developing, bleaching, fixing, and stabilizing. There may be various washing steps between other steps, as well as a pre-bleach step or conditioning step before bleaching. Alternatively, stabilizing can occur between color developing and bleaching. Many details of such processes are provided in U.S. Pat. No. 5,552,264 (Cullinan et al), incorporated herein by reference. Other details are provided in *Research Disclosure,* publication 38957 (noted above), and references noted therein.

Color reversal films used in the practice of this invention are comprised of a support having thereon a plurality of photosensitive silver halide emulsion layers that can contain any conventional silver halide (or mixture thereof). Such films generally have silver halide emulsions having at least 1 mol % iodide based on total silver.

Useful supports are well known and include polyester films, polycarbonate films and cellulose acetate films. The silver halide layers include conventional binder materials, and other conventional addenda. Some specific commercially available color reversal photographic films that can be processed using this invention include EKTACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (3M Corporation).

The first developing step is usually carried out using a conventional black-and-white developing solution that can contain black-and-white developing agents, auxiliary co-developing agents, preservatives, antifoggants, anti-sludging agents, buffers and other conventional addenda.

Color developing is generally carried out using one or more conventional color developing agents, such as primary amino color developing agents. The color developing solution can also include various other conventional addenda including preservatives (including hydroxylamine and its derivatives), fluorescent dyes, sulfites, sequestering agents, corrosion inhibitors and buffers.

Bleaching is generally carried out using one or more bleaching agents that convert metallic silver to silver ions. Binary and ternary ferric complexes of aminopolycarboxylic acids are common bleaching agents, as well as persulfates and peroxides. Other components of the bleaching solution include buffers, halides and sequestering agents.

A photographic stabilizing step can be carried out using any dye stabilizing solution known in the art. Alternatively, a final rinsing step can be used.

For the fixing step of the method of this invention, the concentrated fixing composition of this invention can be diluted up 15 times, and preferably from 3 to 15 times, to provide a working strength or fixing replenishing composition. Dilution can be carried out during or prior to its use in the image formation process. In addition, the concentrated fixing composition can be added to the fixing solution bath, or to the fixer replenisher.

Fixing is generally carried out for conventional times and under conventional conditions. In addition, the fixing compositions of this invention can be used in what would be considered "rapid" processing wherein the fixing step is carried for as little as 10 seconds.

Processing according to this invention can be carried out using any suitable processing equipment, including deep tank processors, and "low volume thin tank" processes including rack and tank and automatic tray designs, as described for example in U.S. Pat. No. 5,436,118 (Carli et al), and publications noted therein. Rotary tube processors can also be used for processing color reversal films.

The concentrated fixing composition of this invention is prepared by mixing the fixing agent and other fixing composition components (in appropriate amounts) with the concentrated additive composition of this invention.

The working strength composition can be prepared either by diluting the concentrated fixing composition appropriately with water and/or buffers, or by adding the concentrated fixing composition directly to the fixing bath or fixer replenisher.

The following examples are provided to illustrate the invention, and not to be limiting in any fashion.

EXAMPLE 1

Concentrated Fixer Additive Composition

A preferred concentrated fixer composition of this invention was prepared by mixing the following two components:

| | |
|---|---|
| BLANKOPHOR REU triazinylstilbene | 0.0715 mol/l |
| Triethanolamine solubilizing compound | 5 mol/l |

This composition was tested for shelf-life stability by keeping samples of it at various temperatures (−18, −7, +5, +10, and +21° C.) for 14 days, and observing if any crystallization occurred. At the completion of this test, no precipitation was evident in the tested samples.

EXAMPLE 2

Concentrated Fixing Composition

A preferred concentrated fixing composition of this invention was prepared by mixing the concentrated fixer additive of Example 1 and other components to provide the following formulation:

| | |
|---|---|
| Ammonium thiosulfate fixing agent | 4.7 mol/l |
| BLANKOHPOR REU triazinylstilbene | 0.004 mol/l |
| Triethanolamine | 0.26 mol/l |
| Sodium metabisulfite | 0.6 mol/l |
| Ethylenediaminetetraacetic acid | 0.02 mol/l |
| Sodium hydroxide | 0.25 mol/l |
| Amount of ammonium ions (of total cations) | 84.7 mol % |
| pH | 6.7 |

EXAMPLES 3 & 4

Working Strength Fixing Composition

Working strength fixing compositions were prepared by diluting the concentrated fixing composition of Example 2 either 6.5 times (Example 3) or 10 times (Example 4) with water. The working strength fixing compositions were used both in processor fixing baths as well as fixing replenishers.

EXAMPLE 5

Alternative Concentrated and Working Strength Fixing Compositions

Concentrated fixer additive and fixing compositions were prepared similarly to those described in Examples 1 and 2 except that diethylene glycol (4.7 mol/l) was used in place of triethanolamine. No precipitation was observed after subjecting the concentrated fixer additive composition to the stability test described in Example 1. The resulting concentrated fixing composition was used to prepare working strength fixing compositions as described in Examples 3 and 4.

EXAMPLE 6

Photographic Processing Using Fixing Compositions

The working strength compositions of Examples 3 and 4 were used for processing several commercially available color reversal photographic films in the following manner.

Samples of FUJICHROME Color Reversal Films, AGFACHROME Color Reversal Films and EKTACHROME Color Reversal Films were imagewise exposed and processed using the following processing sequence and noted conditions and processing compositions (all compositions are commercially available except for the fixing compositions):

| PROCESSING STEP | PROCESSING COMPOSITION | PROCESSING TIME | PROCESSING TEMPERATURE |
|---|---|---|---|
| First Development | KODAK First Developer, Process E-6 | 360 seconds | 38° C. |
| Washing | Water | 120 seconds | 38° C. |
| Reversal bath | KODAK Process E-6 AR Reversal Bath & Replenisher | 120 seconds | 38° C. |
| Color development | KODAK Color Developer, Process E-6 | 360 seconds | 38° C. |
| Conditioning or Prebleaching* | HUNT C6R Conditioner & Replenisher, or KODAK Prebleach Replenisher II, Process E-6 | 120 seconds | 38° C. |
| Bleaching | KODAK Bleach, Process E-6 | 360 seconds | 38° C. |
| Fixing | Example 3 or 4 | 120 seconds | 38° C. |
| Washing | Water | 120 seconds | 38° C. |
| Stabilizing or Final rinsing* | HUNT C6R Stabilizer & Replenisher, Process E-6 or KODAK Final Rinse & Replenisher, Process E-6AR | 60 seconds | 38° C. |

-continued

| PROCESSING STEP | PROCESSING COMPOSITION | PROCESSING TIME | PROCESSING TEMPERATURE |
|---|---|---|---|

*Some experiments were carried out using conditioning and stabilizing steps in the process, while other experiments were carried out using prebleaching and final rinsing steps in the process. The effects of the use of these different steps on the performance of the present invention were insignificant.

The invention has been described in detail with particular reference to preferred embodiments thereof, but it will be understood that variations and modifications can be effected within the spirit and scope of the invention.

We claim:

1. An aqueous working strength photographic fixing composition having a pH of 8 or less, and consisting essentially of:

a) at least 0.1 mol/l of a photographic fixing agent, b) at least 0.25 mol/l of ammonium ions, with the concentration of ammonium ions being at least 60 mol % of the total cations in said composition, c) at least 0.0001 mol/l of a triazinylstilbene, and d) a water-soluble aliphatic compound for stabilizing said triazinylstilbene, said stabilizing compound having a molecular weight of less than 200, from 2 to 10 carbon atoms, and at least two amino or hydroxy functional groups, and being present in said composition at a molar ratio to said triazinylstilbene of at least 2:1.

2. The composition of claim 1 wherein said fixing agent is present in an amount of from about 0.1 to about 2 mol/l, said triazinylstilbene is present in an amount of from about 0.0001 to about 0.0035 mol/l, said stabilizing compound is present in a molar ratio to said triazinylstilbene of from about 2:1 to about 150:1, and ammonium ions comprise from about 60 to 100 mol % of the total cations in said composition.

3. The composition of claim 2 wherein said fixing agent is present in an amount of from about 0.2 to about 1 mol/l, said triazinylstilbene is present in an amount of from about 0.00015 to about 0.002 mol/l, said stabilizing compound is present in a molar ratio to said triazinylstilbene of from about 50:1 to about 80:1, and ammonium ions comprise from about 70 to 100 mol % of the total cations in said composition.

4. The composition of claim 1 wherein said triazinylstilbene is represented by the structure I:

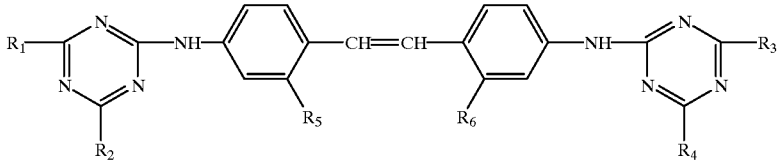

wherein $R_1$, $R_2$, $R_3$ and $R_4$ are independently hydroxy, halo, morpholino, aryl, alkoxy, aryloxy, alkyl, amino, alkylamino or arylamino, and $R_5$ and $R_6$ are independently hydrogen or sulfo, provided at least one of $R_5$ and $R_6$ is sulfo.

5. The composition of claim 4 wherein said stabilizing compound is a glycol or polyhydroxyamine, each having from 2 to 6 carbon atoms.

6. The composition of claim 1 wherein said triazinylstilbene is present in said composition in an amount of from about 0.025 to about 0.15 mol/l, and said stabilizing compound is present at a molar ratio to said triazinylstilbene of from about 2:1 to about 150:1.

7. The composition of claim 6 wherein said triazinylstilbene is present in said composition in an amount of from about 0.05 to about 0.1 mol/l, and said stabilizing compound is present at a molar ratio to said triazinylstilbene of from about 50:1 to about 80:1.

8. The composition of claim 4 wherein $R_1$, $R_2$, $R_3$ and $R_4$ are independently alkoxy, alkylamino or arylamino, and both of $R_5$ and $R_6$ are sulfo.

9. The composition of claim 1 wherein said triazinylstilbene is either of the following compounds II or III, respectively:

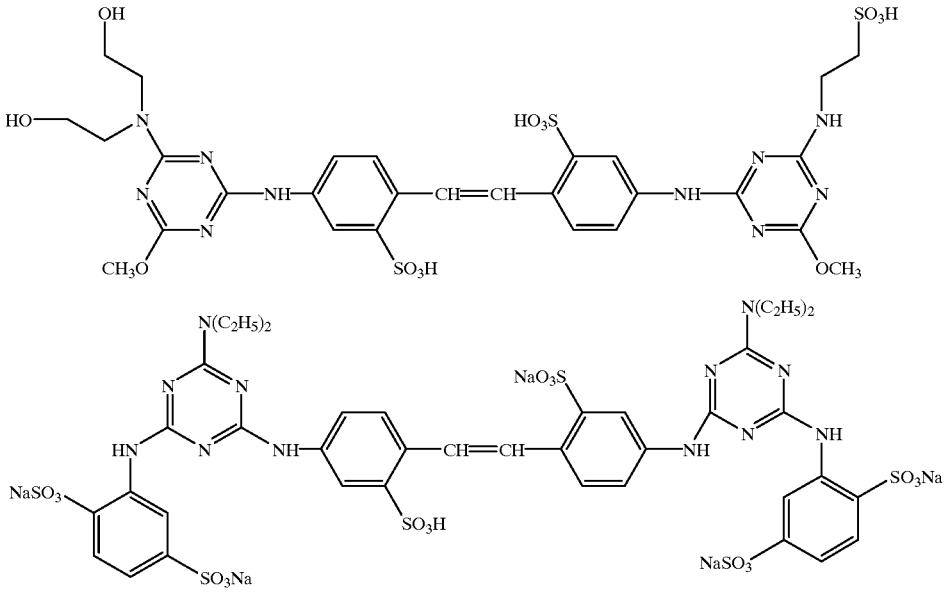

10. The composition of claim 1 wherein said stabilizing compound is ethylene glycol, diethylene glycol, triethylene glycol, diethanolamine, triethanolamine, diisopropanolamine, N,N-bis(hydroxyethyl)amine, or 1,4-dihydroxypyridine.

11. The composition of claim 10 wherein said stabilizing compound is diethylene glycol or triethanolamine.

12. The composition of claim 1 which is a liquid composition having said stabilizing compound as the sole solvent.

13. A method for providing a color image comprising the steps of:

A) bleaching an imagewise exposed and color developed color silver halide photographic element, and B) prior to or after step A, fixing said photographic element with the working strength photographic fixing composition of claim 1.

* * * * *